United States Patent [19]

Hardin

[11] 4,095,864

[45] Jun. 20, 1978

[54] MODULAR MANIFOLDING MEANS AND SYSTEM FOR ELECTRICAL AND/OR PNEUMATIC CONTROL DEVICES AND PARTS AND METHODS

[75] Inventor: George T. Hardin, Knoxville, Tenn.

[73] Assignee: Robertshaw Controls Company, Richmond, Va.

[21] Appl. No.: 782,844

[22] Filed: Mar. 30, 1977

[51] Int. Cl.[2] ..... H01R 3/04

[52] U.S. Cl. ..... 339/15; 137/269; 137/884; 137/885

[58] Field of Search ..... 339/15; 137/269, 271, 137/833, 884, 885

[56] References Cited

U.S. PATENT DOCUMENTS

| | | | |
|---|---|---|---|
| 3,513,876 | 5/1970 | Tarbox | 137/269 X |
| 3,561,469 | 2/1971 | Kellstrom | 137/884 X |
| 3,572,368 | 3/1971 | Bullmer | 137/884 X |
| 3,707,989 | 1/1973 | Jullien-Davin | 137/885 X |

*Primary Examiner*—Roy Lake
*Assistant Examiner*—DeWalden W. Jones
*Attorney, Agent, or Firm*—Candor, Candor & Tassone

[57] ABSTRACT

A manifold adapted to detachably carry on one side thereof a plurality of pneumatically and electrically operated control units each of which is adapted to be fluidly and electrically interconnected to pneumatic structure and electrical structure of the manifold. That one side of the manifold has external interconnecting structure for the pneumatic structure and electrical structure whereby external pneumatic and electrical lines can be interconnected to the same side of the manifold that the units are adapted to be interconnected thereto. The manifold is formed from a frame plate and a plurality of like manifold modules secured to the frame plate to provide a manifold unit, each manifold module having part of the pneumatic structure and the electrical structure and having one side thereof forming part of the one side of the manifold. That one side of each manifold module is adapted to carry one of the control units and has external interconnecting structure respectively for the pneumatic structure and electrical structure thereof.

46 Claims, 20 Drawing Figures

MODULAR MANIFOLDING MEANS AND SYSTEM FOR ELECTRICAL AND/OR PNEUMATIC CONTROL DEVICES AND PARTS AND METHODS

This invention relates to a modular manifold system and manifold means and parts therefor as well as to methods of making such manifold means and parts.

It is well known that a manifold means has been provided for supplying the fluid and electric current needed by a plurality of pneumatically and/or electrically operated control units that can be detachably secured to the manifold means. For example, see U.S. Pat. to Bullmer, No. 3,572,368, and the U.S. Pat. to Tarbox, No. 3,513,876.

However, it was found according to the teachings of the invention in the co-pending patent application, Ser. No. 780,038, filed Mar. 22, 1977 (Robertshaw Controls Company Docket No. 2816-CSD) that such prior known manifold means while permitting all of the desired number of pneumatically and electrically operated control units to be detachably secured to one side of the manifold means, complicated arrangements were provided for interconnecting the external pneumatic and electrical lines to the manifold means whereby installation and repair in the field of such manifold systems are relatively difficult and complicated. For example, in one prior known arrangement, the external electrical lines are attached to the side of the manifold means that is opposite to the exposed side of the manifold means that receives the control units.

Thus, it was a feature of the aforementioned copending patent application to provide a manifold system wherein not only are the pneumatically and electrically operated control units readily detachably secured to one side of the manifold means thereof, but also the external pneumatic and electrical lines are interconnected to the same side of the manifold means that the control units are interconnected thereto to facilitate the ease of installation and repair of such a manifold system.

It is a feature of this invention to provide improvements in the manifold system, manifold means, parts and methods of the aforementioned co-pending patent application.

In particular, one embodiment of this invention provides a manifold means adapted to detachably carry on one side thereof a plurality of pneumatically and electrically operated control units each of which is adapted to be fluidly and electrically interconnected to pneumatic means and electrical means of the manifold means. The one side of the manifold means has external interconnection means for the pneumatic means and electrical means thereof whereby external pneumatic and electrical lines can be interconnected to the same side of the manifold means that the control units are adapted to be interconnected thereto. The manifold means comprises a plurality of like manifold modules secured together to provide a manifold unit and each having part of the pneumatic means and electrical means and having one side thereof forming part of the one side of the manifold means. The one side of each manifold module is adapted to carry one of the control units and has external interconnection means respectively for the pneumatic means and electrical means thereof.

While the aforementioned U.S. Pat. to Tarbox, No. 3,513,876, and the U.S. Pat. to Kawabata, No. 3,457,943; Jullien-Davin, No. 3,707,989, and Raymond, 3,817,269, each provide a manifold means formed from a plurality of like manifold modules secured together, none of these patents teaches or suggests having each manifold module having one side thereof being adapted to carry an electrically and pneumatically operated control unit and being provided with external interconnection means respectively for the pneumatic means and electrical means thereof that interconnect with the control unit so that external pneumatic and electrical lines can be interconnected to the same side of the manifold module that the control unit is adapted to be interconnected thereto as provided by the teachings of this invention.

Accordingly, it is an object of this invention to provide an improved manifold system having one or more of the novel features of this invention as set forth above or hereinafter shown or described.

Another object of this invention is to provide an improved manifold means for such a manifold system or the like, the manifold means of this invention having one or more of the novel features of this invention as set forth above or hereinafter shown or described.

Another object of this invention is to provide improved parts for such a manifold system or the like, the parts of this invention each having one or more of the novel features of this invention as set forth above or hereinafter shown or described.

Another object of this invention is to provide a method of making the manifold means of this invention, the method of this invention having one or more of the novel features of this invention as set forth above or hereinafter shown or described.

Another object of this invention is to provide a method of making a part of the manifold system of this invention, the method of this invention having one or more of the novel features of this invention as set forth above or hereinafter shown or described.

Other objects, uses, and advantages of this invention are apparent from a reading of this description which proceeds with reference to the accompanying drawings forming a part thereof and wherein.

Figures 1, 2:
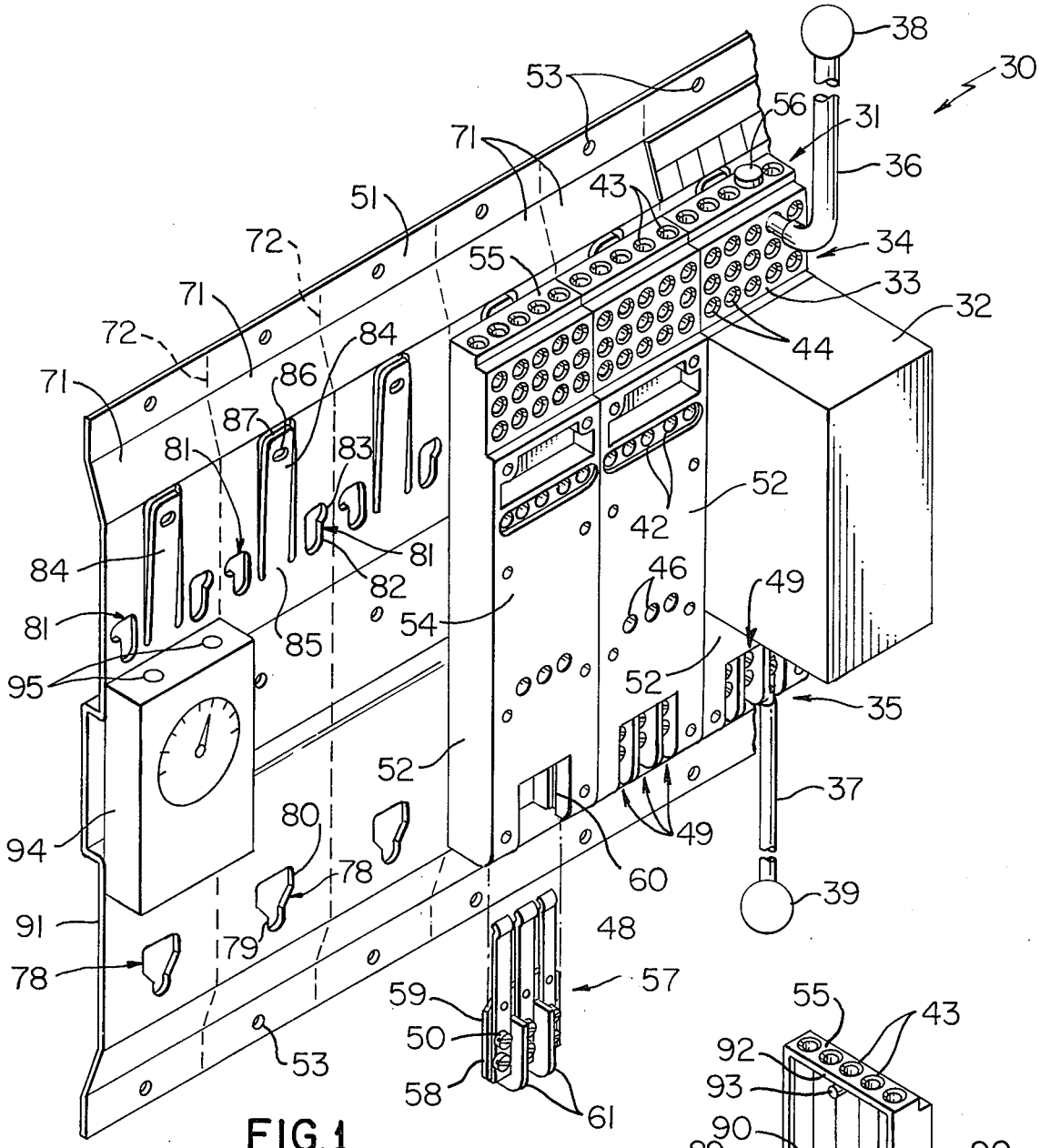
FIG. 1 is a fragmentary perspective view, partially exploded, illustrating the improved modular manifolding system of this invention.
FIG. 2 is a rear perspective view of one of the manifold modules of the manifold system of FIG. 1.

While the various features of this invention are hereinafter described and illustrated as being particularly adapted to provide a manifold means for pneumatically and electrically operated control units, it is to be understood that the various features of this invention can be utilized singly or in any combination thereof to provide manifold means for other types of units as desired, such as control units that are only pneumatically operated or just electrically operated or a combination thereof.

Therefore, this invention is not to be limited to only the embodiments illustrated in the drawings, because the drawings are merely utilized to illustrate one of the wide variety of uses of this invention.

Figure 3:
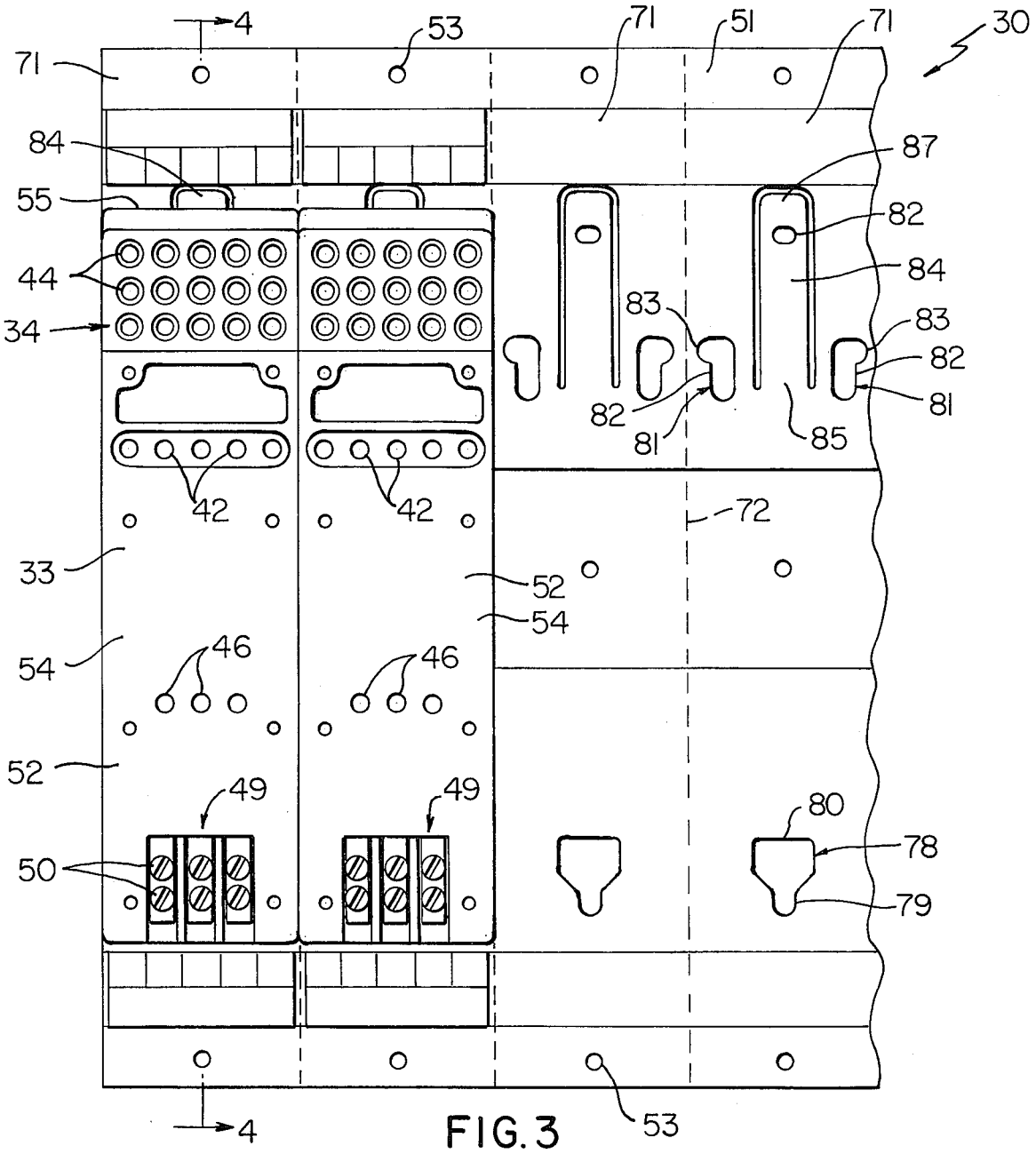
FIG. 3 is an enlarged top view of the manifold system of FIG. 1.
Figure 4:
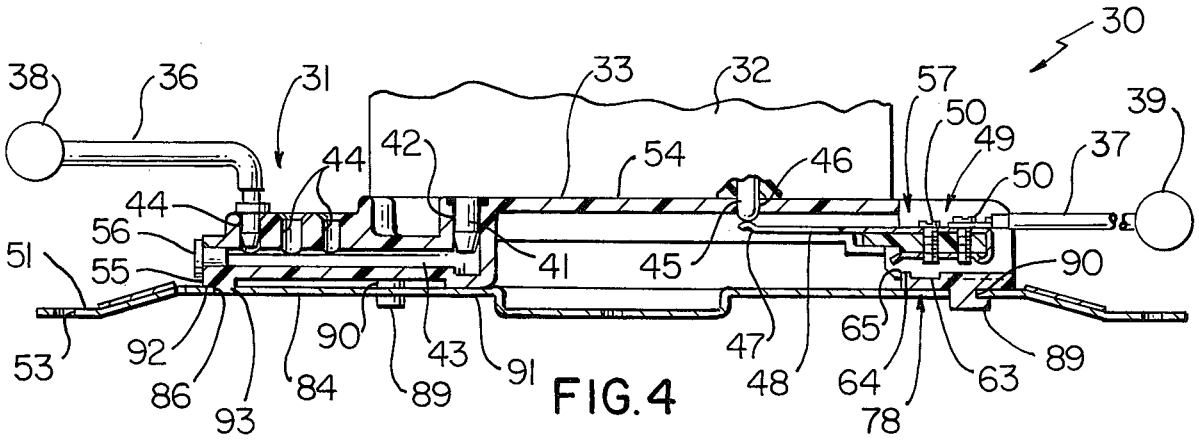
FIG. 4 is a cross-sectional view taken on line 4—4 of FIG. 3.

Referring now to FIGS. 1, 3 and 4, the improved manifolding system of this invention is generally indicated by the reference numeral 30 and comprises a manifolding means generally indicated by the reference numeral 31 detachably carrying a plurality of pneumatically and electrically operated control units 32 on one side 33 thereof that also has an upper row of external interconnection means generally indicated by the reference numeral 34 and a lower row of external interconnection means generally indicated by the reference numeral 35 for respectively being interconnected to external pneumatic lines 36 and external electrical lines 37 for respectively supplying fluid and electrical current from suitable sources 38 and 39 external to the manifold system 30 to operate the control devices 32 in a manner well known in the art for any desired purpose, such as for controlling the heating and cooling systems for a large building and the like.

The manifolding system 30 can be mounted in a control room in a conventional manner, such as by being placed and secured inside a control cabinet or the like, such as the control cabinet 40 of FIGS. 18 and 19 and hereinafter described.

Each control unit 32 can be provided with one or more plug-in nipples 41, FIG. 4, which are adapted to be received in plug-in recess means 42 formed in the side 33 of the manifold means 31, each recess means 42 interconnecting with an internal passage 43 of the manifold means 31 that define part of the pneumatic means thereof.

Each passage 43 interconnects with the external interconnection means 34 which comprises a plurality of recesses 44 formed in the side 33 of the manifold means 31, three of such recesses 44 being provided for each passage 43 and being disposed in spaced aligned relation. The three recesses means 44 for each passage 43 are disposed in spaced parallel relation with the recesses 44 of the other passages 43 as illustrated in FIG. 1.

Thus, the passages 43 provide a pneumatic means of the manifold means 31 for supplying fluid to and from the external lines 36 between the recesses 44 and the recess means 42 leading to the output or input nipple means 41 of the control devices 32.

Similarly, the control devices 32 have one or more electrical contact members or pins 45, FIG. 4, adapted to each project through a respective opening or recess 46 in the side 33 of the manifold means 31 to engage against the free end 47 of a conductive leaf member 48 forming part of a terminal means 49, the terminal means 49 defining the external interconnection means 35 for the manifold means 31.

Each conductive leaf 48 of each terminal means 49 is fastened to the manifold means 31 by a pair of conductive threaded fastening members 50 in a manner hereinafter described so that each fastening member 50 is adapted to fasten an external electrical line 37 to the leaf member 48 whereby a pair of electrical lines 37 can be fastened to each terminal 49 if desired.

In this manner, electrical current from the source 39 can be interconnected by the external lines 37 and the electrical means 48 of the manifold means 31 to the conductive members 45 of the control devices 32 to operate the control devices 32 in a manner well known in the art.

Thus, it can be seen that providing a plurality of plug-in recess means 42 in the side 33 of the manifold means 31 in the manner illustrated in FIGS. 1, 3 and 4, a desired number of control devices 32 can be plugged into the manifold means 31 on the side 33 thereof to have the pneumatically and electrically operated structure of the control units 32 be readily interconnected to the pneumatic means 43 and electrical means 48 of the manifold means 31 which in turn has the external interconnection means 34 and 35 thereof interconnected to external pneumatic lines 36 and electrical lines 37 on the same side 33 of the manifold means 31 whereby it is relatively easy to install the manifold means 31 in a cabinet or the like during the initial installation thereof as well as to subsequently interconnect the desired number of external lines 36 and 37 to the desired external interconnection means 44 and 49 for the devices 32 to function in a conventional manner, such feature of the manifold means 31, manifold system 30 and method previously described providing the same inventive features of the aforementioned co-pending patent application.

However, the manifold means 31 of this invention is formed in a unique manner rather than being formed of a one-piece member as in the aforementioned co-pending patent application.

In particular, the manifold means 31 illustrated in FIGS. 1, 3 and 4 comprises a base plate 51 formed of metal, plastic or any suitable material and formed in a manner hereinafter described to detachably carry a plurality of like manifold modules 52 formed of any suitable plastic material or the like as illustrated so as to be non-conductive, the manifold modules 52 being adapted to be arranged in side-by-side relation on the base plate 51 with the base plate 51 being adapted to be secured to any desired structure by suitable fastening means passing through opening means 53 formed therein for such mounting purposes.

In the embodiment of the manifold module 52 illustrated in the drawings, each manifold module 52 has an upper surface 54 interrupted by three rows of five recesses 44 and five recess means 42 operatively associated therewith while only being provided with three recesses 45 and three terminal members 49 operatively associated therewith.

However, it can readily be seen that the side 54 of each manifold module 52 forms that part of the side 33 of the manifold means 31 that receives the control units 32 as well as the external pneumatic and electrical lines 36 and 37 so that each manifold module 52 provides part of the interconnection means 34 and 35 as well as the means 42 and 46 for detachably carrying a control unit 32 on the side 54 thereof.

Each relay module 52 can be readily formed by molding the same with passages 43 terminating at the end surface 55 thereof which can be subsequently plugged by suitable flexible sealing plugs 56 in the manner illustrated in FIG. 4 to close off the passages 43 except at the recesses 44 thereof.

Similarly, the unused recesses 44 in the manifold modules 52 could be closed by the plugs 56 or other suitable means as desired.

Figure 5:
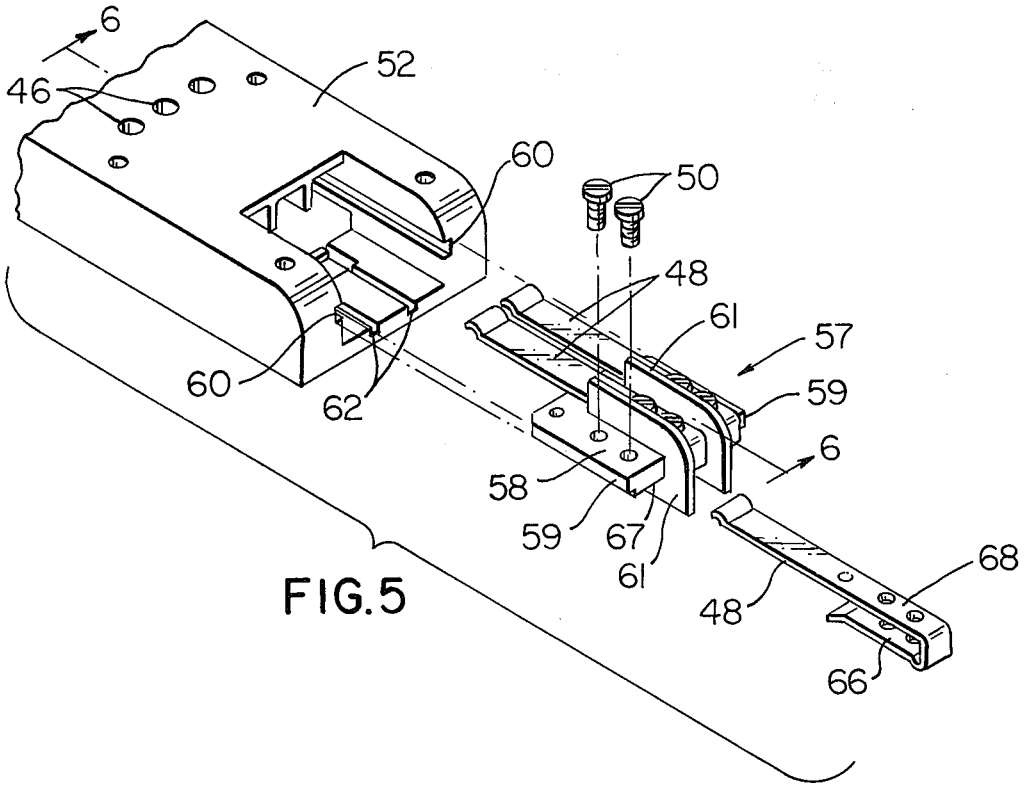
FIG. 5 is a fragmentary exploded perspective view of the terminal end of one of the manifold modules of this invention.
Figure 6:
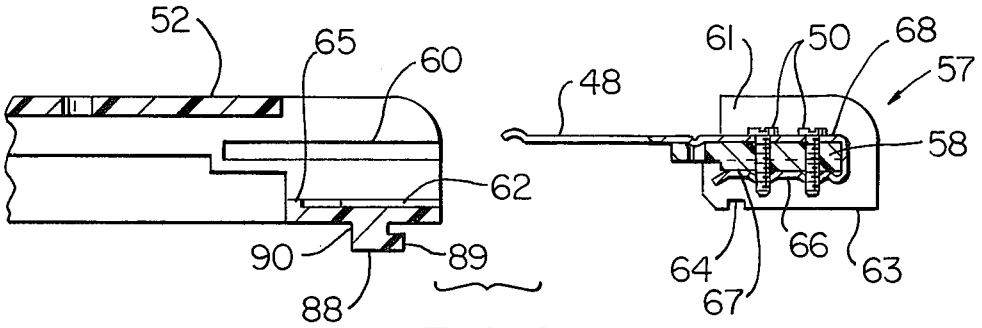
FIG. 6 is a fragmentary cross-sectional view taken on line 6—6 of FIG. 5.

The three terminal means 49 for each manifold module 52 are part of a terminal block means that is generally indicated by the reference numeral 57 in FIGS. 5 and 6 and is adapted to be detachably secured to its respective manifold module 52 so that if it is desired to utilize a particular manifold module 52 for only the purpose of interconnecting the pneumatic means to the control unit 32 being carried thereby, then that particular manifold module 52 need not have the terminal block 57 inserted therein.

However, if it is desired to utilize the terminal block 57, the same can be readily snap-fitted into position on the particular manifold module 52 as illustrated in FIGS. 4, 5 and 6.

In particular, each terminal block 57 comprises a base member 58 formed of plastic material and having outwardly directed side flanges 59 respectively being adapted to be received in slots 60 formed in the respective manifold module 52 as illustrated in FIGS. 5 and 6, the base member 58 having a pair of transversely disposed and spaced apart parallel web sections 61 integral therewith and respectively being adapted to be received in a pair of bottom slots 62 of the respective manifold module 52.

Each web 61 in the lower surface 63 thereof has a notch 64 adapted to snap-fittingly receive an upwardly directed flange 65 of the respective manifold module 52 that is located at the end of its respective slot 62 so that when the terminal block 57 is inserted into the slots 60 and 62 and pushed all the way inwardly in the manner illustrated in FIG. 4, the tongues 65 of the manifold module 52 snap into the cutouts 64 to snap-fittingly hold the terminal block 57 in its assembled relation with the respective manifold module 52. However, if sufficient force is applied, the terminal blokc 57 can be unsnapped from the tongue 65 when it is desired to remove a terminal block 57 from its respective manifold module 52.

Each terminal block 57 carries three conductive leaves 48 with each leaf 48 having a bent back lower portion 66 that engages against the underside 67 of the base 58 of the respective terminal block 57 so that the threaded fastening members 50 not only pass through an upper part 68 of the respective conductive leaf 48, but also through the lower part 66 thereof to firmly fasten the respective leaf 48 to the base 58 of the terminal block 57.

Therefore, it can be seen that it is relatively simple procedure to form the terminal block 57 of this invention and to snap-fittingly secure the same in its respective manifold module 52 whereby such manifold module 52 can subsequently have such terminal block 57 readily removed therefrom if desired.

However, it is to be understood that the terminal block arrangement 57 of this invention could form an integral part of the respective relay module 52 if desired.

Figure 7:
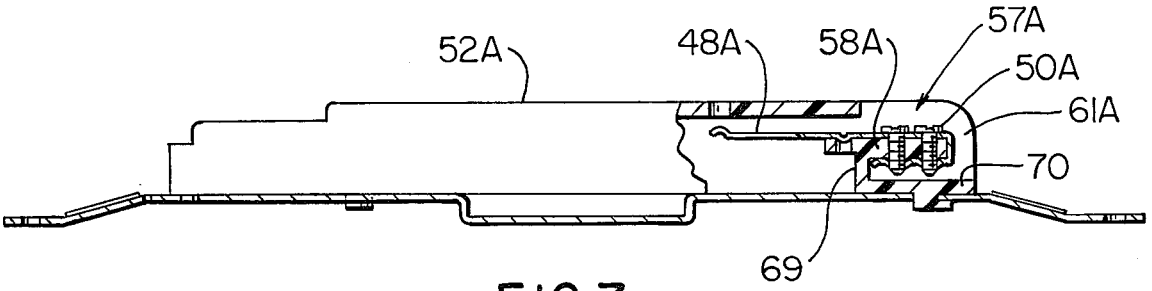
FIG. 7 is a cross-sectional view similar to FIG. 4 and illustrates another embodiment of the manifold module of this invention.

For example, reference is made to FIG. 7 wherein another manifold module 52A of this invention is illustrated and parts thereof similar to the manifold module 52 previously described are indicated by like reference numerals followed by the reference letter "A".

As illustrated in FIG. 7, the manifold module 52A has a terminal block 57A integral therewith as the base plate 58A of the terminal block 57A has a depending part 69 integral with a bottom flange 70 of the body of its manifold module 52A so that the integral base plate 58A extends from side to side in the module 52A and carries the plurality of conductive leaves 48A by the threaded fastening members 50A. Integral web portion 61A of the manifold module 52A can separate each leaf 48A from the adjacent leaves 48A thereof as desired in the same manner as the web portions 61 of the removable terminal block 57 previously described.

In order to detachably secure each manifold module 52 to the base plate 51, the base plate 51 is divided into like longitudinal sections 71 disposed in side-by-side relation with each section 71 being adapted to receive and secure a manifold module 52 thereto. In fact, the base plate 51 can be provided with suitable marking 72 thereon to indicate the boundaries of the various sections 71 thereof so that a base plate 51 having a desired number of sections 71 could be cut off from an elongated length of base plate material to provide a base plate 51 of just the desired length for making a particular sized manifold means 31.

Each section 71 of the base plate 51 is provided with a lower opening 78 passing therethrough and having a reduced lower part 79 and an enlarged upper part 80. Each section 71 also has a pair of like upper openings 81 each provided with reduced lower part 82 and an enlarged upper part 83 for a purpose hereinafter described.

Each section 71 also has a cantilevered lever 84 carved therefrom so as to be integral therewith at the base 85 of the lever 84 and being provided with an opening 86 in the free end 87 thereof for a purpose hereinafter described.

Each manifold module 52 has three feet 88 formed integrally therewith with each foot 88 having an outwardly directed flange 89 at the outer end thereof so as to be spaced from the body portion of the manifold module 52 and outwardly from the projecting part 90 thereof whereby the feet 88 are each adapted to be respectively received in the enlarged parts 80 and 83 of the openings 78 and 81 of a particular section 71 of the base plate 51 and then be moved downwardly into the reduced portions 79 and 82 thereof so that the flange parts 89 of the feet 88 overlap against the back surface 91 of the base plate 51 in the manner illustrated in FIG. 4 to hold the manifold module 52 against the base plate 51. The tongues 84 are normally biased outwardly from the plate 51 so that end tongue 84 engages the underside 92 of the respective manifold module 82 as illustrated in FIG. 4 and a cylindrical projection 93 of the particular manifold module 52 is received in the opening 86 of the tongue 84 to lock therewith and thereby prevent the relay module 52 from shifting to the left in FIG. 4 to unlock the flanges 89 of the feet 88 from their interlocking relation from the undersurface 91 of the base plate 51.

However, it is relatively easy to detach a secured manifold module 52 from the base plate 51 by merely pushing downwardly on the free end 87 of the respective tongue 84 of the base plate 51 to free the cylindrical projection 93 from the opening 86 thereof and then merely slide the manifold module 52 to the left in FIG. 4 so that the feet 88 are now received in the large portions 80 and 83 of the openings 78 and 81 to be pulled out of the same.

Thus, each manifold module 52 can be snap fit into a particular section 71 of the base plate 51 with a simple sliding motion once the feet 88 have been aligned with the large portions 80 and 83 of the openings 78 and 81 in the manner previously described and then shoved downwardly in FIG. 1 to cause the projection 93 of the manifold module 52 to cam into the opening 86 of the tongue 84 and be locked therein. In this manner, the tongue 84 and openings 78 and 81 cooperate with the feet 88 of the respective manifold module 52 to provide a quick connect and a quick disconnect arrangement.

While the manifold modules 52 can be secured to the sections 71 of the base plate 51 in side-by-side relation as shown in the right portion of FIG. 1, it is to be understood that one or more sections 71 can be skipped so that any desired pattern of manifold modules 52 can be provided on any base plate 51 as desired. Further, the base plate 51 can carry other structures than just the manifold modules 52, if desired.

For example, an indicating gauge component 94 is illustrated in FIG. 1 as being secured in the lefthand section 71 of the base plate 51 and can have suitable interconnection means 95 for being interconnected to the source 38 or other structure by external piping as desired.

Thus, this invention is not limited to the base plate 51 only carrying the manifold modules 52 or with the manifold modules 52 being secured thereon in a particular pattern.

Figure 9:
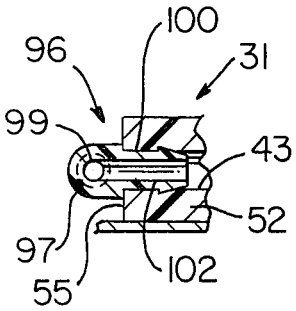
FIG. 9 is a fragmentary cross-sectional view taken on line 9—9 of FIG. 8.
Figure 8:
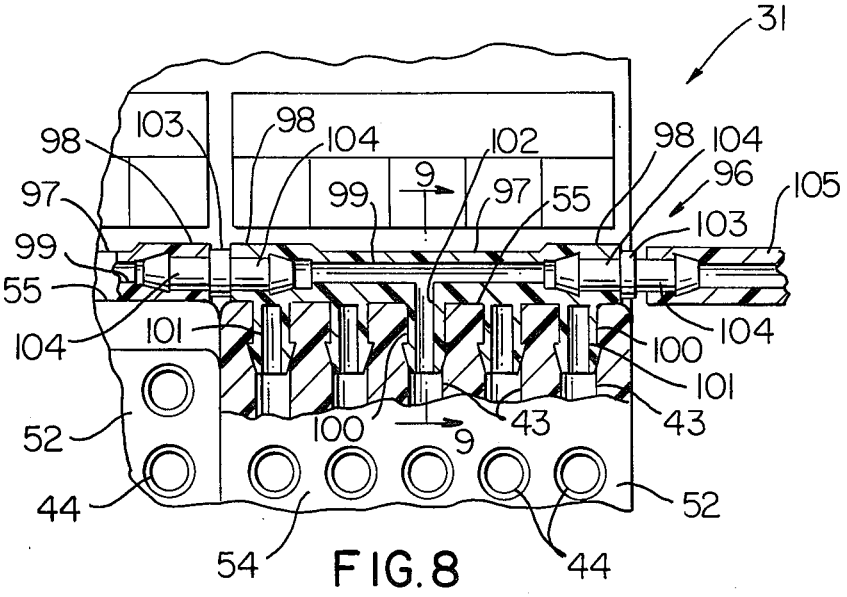
FIG. 8 is a fragmentary cross-sectional view similar to FIG. 3 and illustrates a conduit system for the manifold modules of this invention.

If desired, an external conduit system can be provided for the manifold modules 52 of the manifold means 31 of this invention and such a conduit system is generally indicated by the reference numeral 96 in FIGS. 8 and 9 and comprises a flexible conduit member 97 having like opposed ends 98 and a central passage 99 interrupting those ends 98 and extending completely through the same.

The conduit member 97 has a plurality of nipples 100 extending transversely therefrom and respectively adapted to be sealingly received in the passages 43 of a manifold module 52 at the end 55 thereof as illustrated in FIG. 8 to completely close all of the passages 43. If desired, each nipple 100 can have a partial opening 101 formed therein and terminating short of the main passage 99 thereof so that only those nipples 100 which are desired to be interconnected to the passage 99 can be subsequently further bored by a suitable tool to provide a complete passage therethrough, such as passage 102 in the center nipple 100 in FIG. 8 which fluidly interconnects with the main passage 99.

A conduit member 97 can be provided for each relay module 52 and adjacent conduit members 97 of a manifold means 31 can be fluidly interconnected together by a plug connector 103 having opposed nipple ends 104 adapted to be received respectively in adjacent ends 98 of adjacent conduit members 97 to fluidly interconnect the same together. In this manner, another plug connector 103 at the righthand end of FIG. 8 can be utilized to interconnect an external pneumatic line 105 to the manifold means 31 illustrated in FIGS. 8 and 9.

Thus, it can be seen that the external conduit members 97 can be utilized to fluidly interconnect desired passages 43 of the manifold modules 52 of a particular manifold means 31 while the recesses 44 in the surfaces 54 of the manifold modules 52 can still be utilized for subsequently interconnecting external pneumatic lines thereto such as the pneumatic lines 36 previously described.

Figure 17:
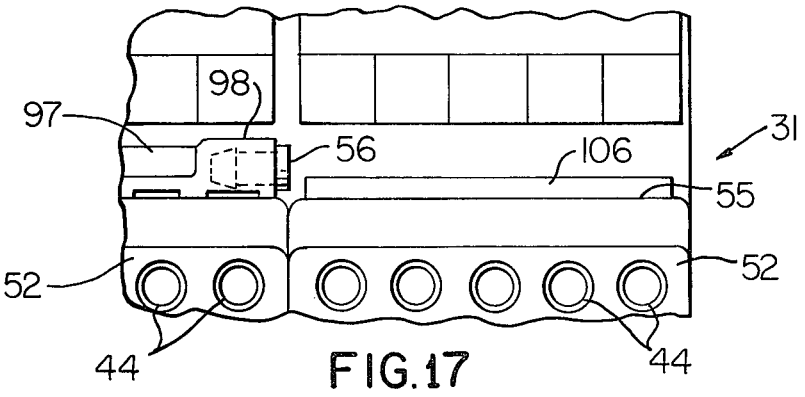
FIG. 17 is a view similar to FIG. 8 and illustrates another arrangement of the conduit system for the manifold modules of this invention.

While the conduit members 97 have been illustrated and described in FIGS. 8 and 9 as being continuous down the ends 55 of the manifold modules 52 thereof, it is to be understood that such members 97 need not be utilized to interconnect all of the manifold modules 52 together. For example, reference is now made to FIG. 17 wherein two adjacent manifold modules 52 of a manifold means 31 are provided and only the lefthand manifold module 52 has a conduit member 97 with its right end 98 being closed by a plug 56 as utilized in FIG. 4 while all of the passages 43 of the righthand manifold module 52 are closed by a flexible plug assembly 106 that has a plurality of nipples (not shown) respectively received in the ends of the passages 43 of the righthand manifold module 52 in substantially the same manner as the plug 56 of FIG. 4 except that all five nipples are interconnected by the web portion of the plug assembly 106.

The various recesses 44 and passages 43 at the end 55 of the manifold modules 52 of this invention can utilize various external plug connectors for interconnecting the exterior pneumatic lines 36 thereto.

Figure 10:
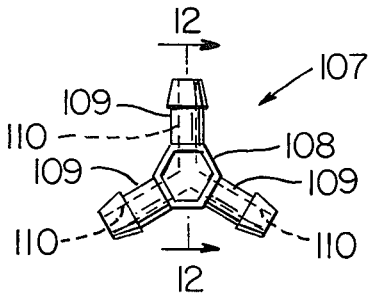
FIG. 10 is a view of a plug connector of this invention.
Figure 11:
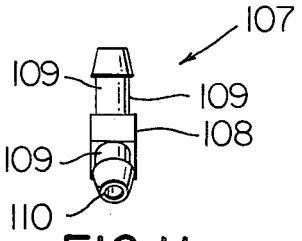
FIG. 11 is a side view of the plug connector of FIG. 10.
Figure 12:
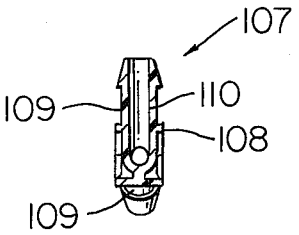
FIG. 12 is a cross-sectional view taken on line 12—12 of FIG. 10.

For example, a Y-shaped plug connector is generally indicated by the reference numeral 107 in FIGS. 10–12 and comprises a body portion 108 having three radiating plug nipples 109 extending outwardly therefrom and respectively having passages 110 therein interconnecting together with each other whereby one of the plug connectors 109 can be readily inserted in a recess 44 of a particular manifold module 52 and the other two plug connectors 109 can be utilized for interconnecting to external pneumatic lines 36 or for either interconnecting adjacent recesses 44 of the same manifold module 52 or adjacent manifold modules 52 thereto or other means as desired.

Figure 13:
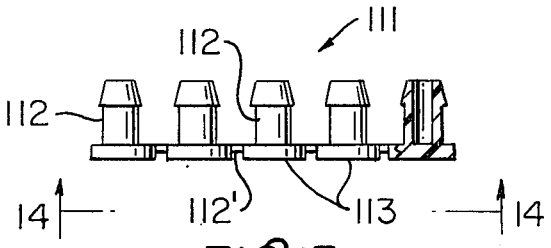
FIG. 13 is a side view of a plug assembly of this invention.
Figure 14:
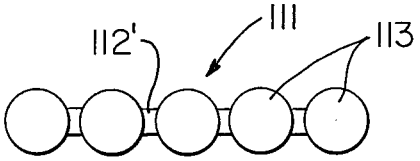
FIG. 14 is an end view of the plug assembly of FIG. 13 and is taken in the direction of the arrows 14—14 of FIG. 13.

Should it be desired to seal off a row of recesses 44 in a particular manifold module 52 in a simple manner, a flexible plug assembly 111 of FIGS. 13 and 14 can be utilized and comprises a web portion 112' integrally carrying a plurality of nipple connectors 112 adapted to be respectively received in a row of recesses 44 and since the plug connectors 112 are initially closed off in the manner illustrated in FIGS. 13, the same will seal the recesses 44 at the top surface 54 of the particular manifold module 52. Of course, if desired, the disc ends 113 of a plug connector 112 could be ruptured to insert a tube therein to interconnect such tube to the particular recess 44 receiving that plug connector 112.

Figure 15:
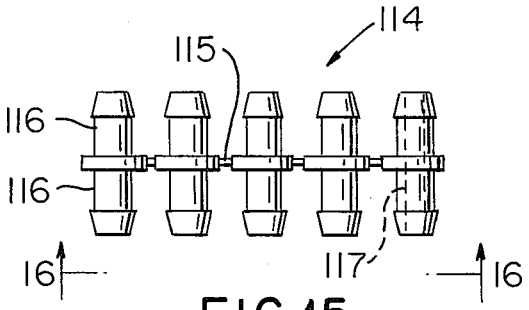
FIG. 15 is a side view of a plug connector assembly of this invention.
Figure 16:
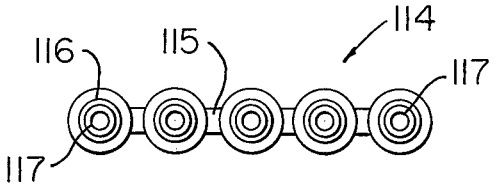
FIG. 16 is an end view of the plug connector assembly of FIG. 15 and is taken in the direction of the arrows 16—16 of FIG. 15.

Another flexible plug connector assembly of this invention is generally indicated by the reference numeral 114 in FIGS. 15 and 16 and comprises a web portion 115 carrying a plurality of integral and oppositely directed nipple connectors 116 which have passages 117 passing completely therethrough in the manner illustrated in FIG. 16 whereby the five plug connectors 116 can be easily inserted into a row of recesses 44 in the surface 54 of a manifold module 52 so that five external penumatic lines can be interconnected thereto by being inserted over the outwardly directed portions of the plug connectors 116 in a manner well known in the art.

Thus, it can be seen that different forms of pneumatic connectors and assemblies can be readily utilized with the manifold modules 52 of this invention to provide for means for readily and simply interconnecting the manifold modules 52 together or to interconnect the same to external pneumatic lines 36 or other devices as desired.

Figure 18:
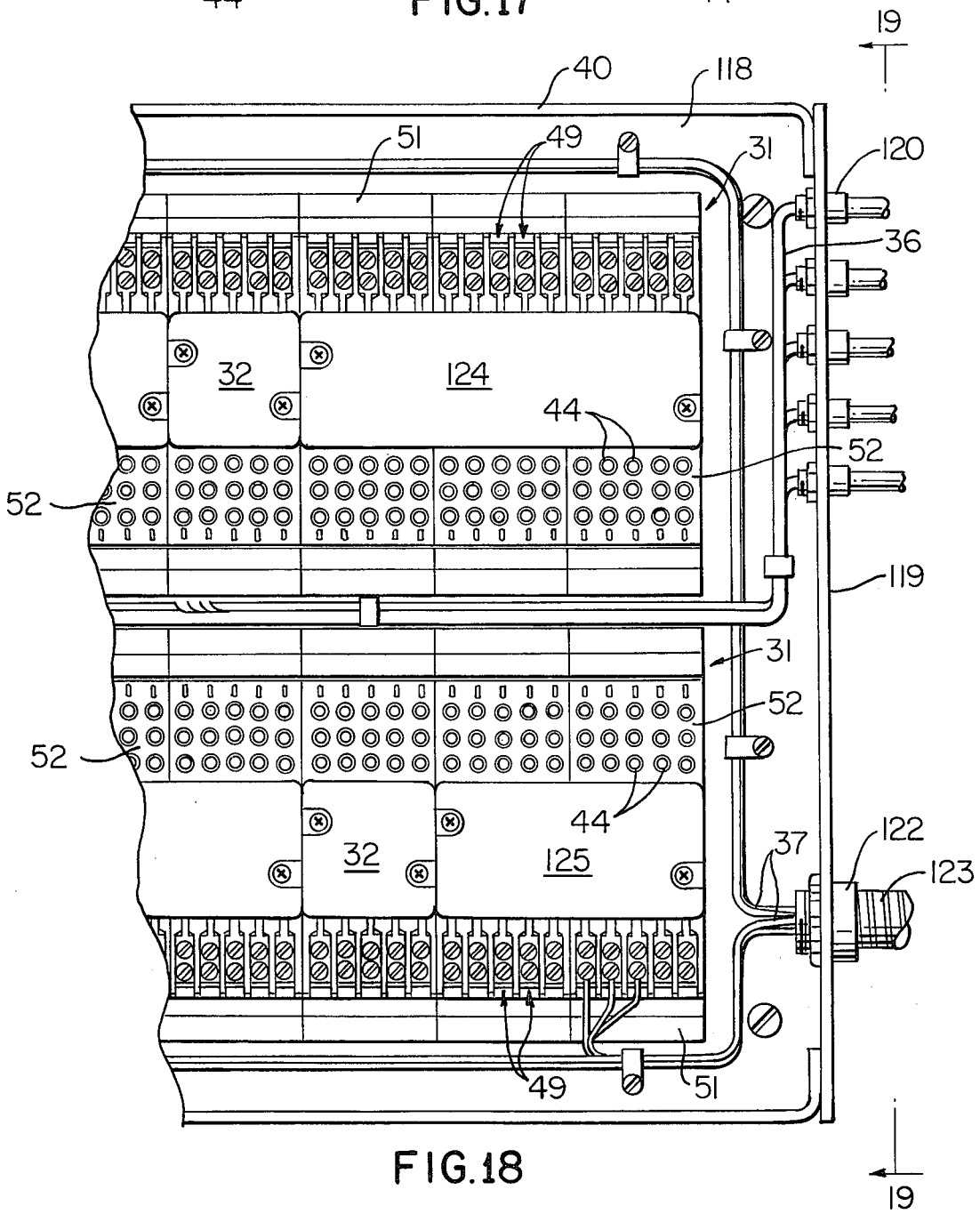
FIG. 18 is a fragmentary front view of an open cabinet structure containing a plurality of manifold means of this invention.
Figure 19:
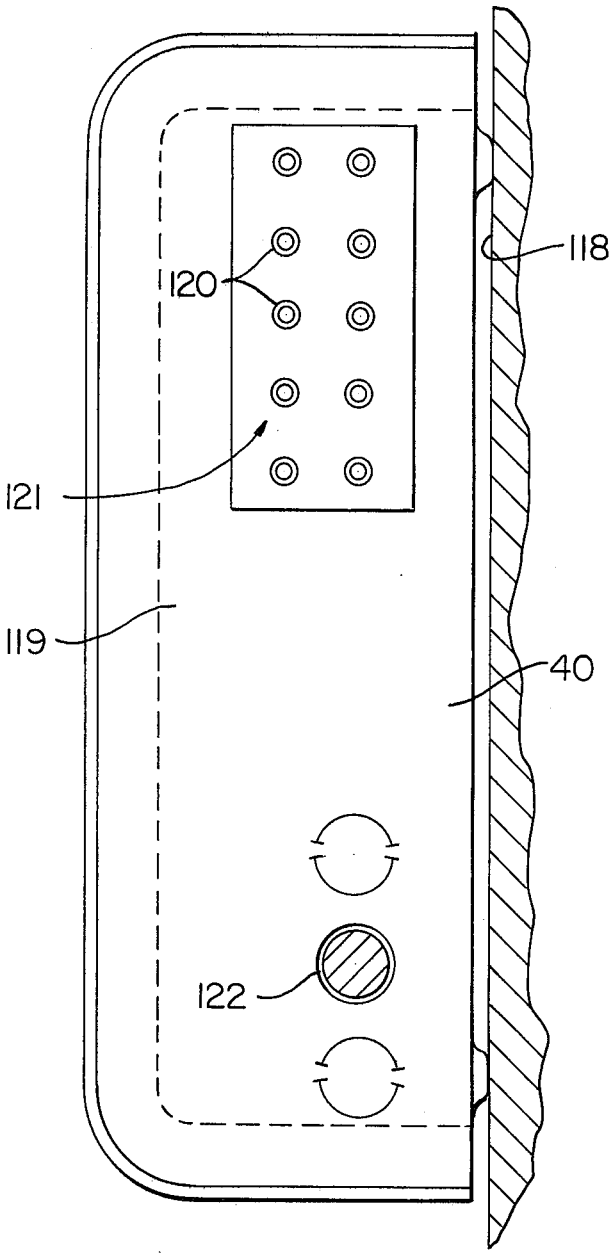
FIG. 19 is an end view of the cabinet structure of FIG. 18 and is taken in the direction of the arrows 19—19 of FIG. 18.

As previously stated, the manifold means 31 of this invention can have the frame plate 51 thereof secured in a cabinet structure 40 in the manner illustrated in FIGS. 18 and 19 wherein a plurality of manifold means 31 can be mounted in the same cabinet 40 as desired.

As illustrated in FIGS. 18 and 19, the cabinet structure 40 can comprise a back wall 118 to which the frame plates 51 of the two manifold means 31 illustrated in FIG. 18 are readily secured. A side wall 119 of the cabinet structure 40 can be provided with a plurality of conduit receiving connectors 120 in the pattern illustrated by the reference numeral 121 in FIG. 19 so that a plurality of external pneumatic lines 36 can be readily interconnected to the desired recesses 44 in the manifold modules 52 (such interconnection between the lines 36 and the recesses 44 not being shown in FIG. 18).

In addition, the side 119 of the cabinet 40 can be provided with an electrical connector 122 for receiving an external cable 123 having a plurality of electrical lines 37 for respectively interconnecting to the desired terminals 49 of the manifold modules 52 (only some of the lines 37 being interconnected to the terminals 49 are illustrated in FIG. 18).

Therefore, it can be seen that it is relatively simple procedure to mount the manifold means 31 of this invention in a cabinet structure 40 or against a wall or against any other suitable structure through the frame plate 51 thereof, such frame plate 51 thus being mounted to the desired structure and then having the manifold modules 52 snapped in place in the manner previously described or attached thereto before the frame plate 51 is mounted in place, as desired.

Further, such manifold modules 52 then can receive the desired components 32 in the manner previously described and while the components 32 have been previously described as each being utilized on only one manifold module 52, it is to be understood that the pneumatically and electrically operated components could comprise relatively large components that would span across several manifold modules 52 of a manifold means 31, such as the control unit 124 in FIG. 18, or just across two of the manifold modules 52 as provided by the control unit 125 of FIG. 18. The control units 124 and 125 interconnect with the pneumatic means 43 and electrical means 48 of a desired number of manifold modules 52 through suitable nipple means 42 and electrical connectors 45 thereof in the manner previously described.

While the manifold modules 52 of this invention have been previously described as being adapted to be able to quick connect and quick disconnect from the frame plate 51 to provide the manifold means 31 previously described, it is to be understood that a manifold means can be built up by a plurality of manifold modules formed according to the teachings of this invention with such manifold modules being more permanently attached to any desired plate structure.

Figure 20:
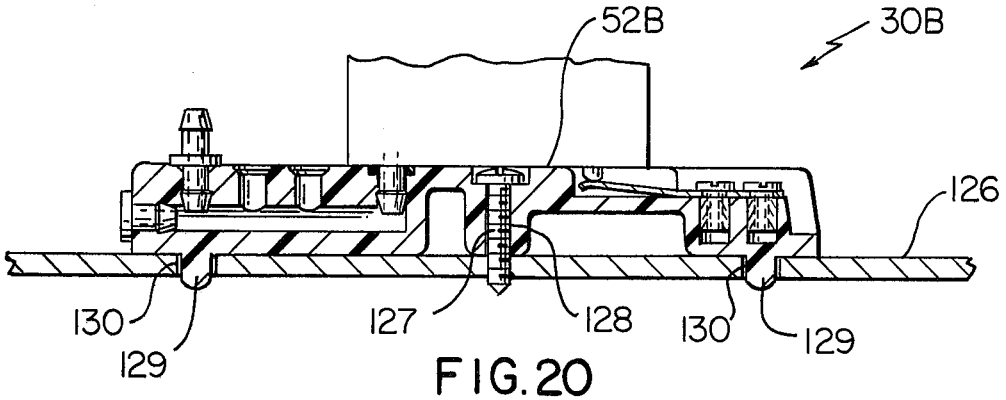
FIG. 20 is a view similar to FIG. 4 and illustrates another embodiment of the manifold module, manifold means and manifold system of this invention.

For example, reference is made to FIG. 20 wherein another modular manifolding system of this invention is generally indicated by the reference numeral 30B and parts thereof similar to the system 30 previously described are indicated by like reference numerals followed by the reference letter "B".

As illustrated in FIG. 20, each manifold module 52B is adapted to be fastened to a base plate 126 by a threaded fastening member 127 passing through an opening 128 formed through the manifold module 52B in substantially the center portion thereof and such manifold module 52B can be held in place on the plate 126 and be prevented from rotating thereon by having integral projections 129 of the manifold module 52B received in suitable openings 130 formed through the plate 126 as illustrated.

Thus, it can be seen that the manifold module of this invention can be modified in any desired manner to attach to any desired structure, the plate 126 either being a separate plate for the manifold modules 52B or actually being part of a cabinet wall, as desired.

Therefore, it can be seen that is is a relatively simple manner to make the manifold modules of this invention according to the methods of this invention and, thereafter, secure such manifold modules together to provide a manifold means of this invention to detachably carry a desired number of pneumatically and electrically operated components to provide the improved modular manifolding systems of this invention, such systems readily permitting external pneumatic lines and electrical lines to be readily attached to the same side of the manifold means that carries the control units to facilitate the ease of installation and repair of such systems in the field or the like.

While the forms and methods of this invention now preferred have been illustrated and described as required by the Patent Statute, is to be understood that other forms and method steps can be utilized and still fall within the scope of the appended claims.

What is claimed is:

1. In a manifold means adapted to detachably carry on one side thereof a plurality of pneumatically and electrically operated control units each of which is adapted to be fluidly and electrically interconnected to pneumatic means and electrical means of said manifold means that respectively have external interconnection means on said one side of said manifold means so that external pneumatic and electrical lines can be interconnected to the same side of said manifold means that said units are adapted to be interconnected thereto, the improvement wherein said manifold means comprises a plurality of like manifold modules secured together to provide a manifold unit and each having part of said pneumatic means and said electrical means and having one side thereof forming part of said one side of said manifold means, said one side of each manifold module being adapted to carry one of said control units and has said external interconnection means respectively for said pneumatic means and electrical means thereof.

2. A manifold means as set forth in claim 1 wherein said external interconnection means for said electrical means of each module is detachably carried by the respective manifold module.

3. A manifold means as set forth in claim 1 wherein said external interconnection means for said electrical means of each manifold module comprises a terminal block having a plurality of separate electrical terminals thereon.

4. A manifold means as set forth in claim 3 wherein said terminal block for each manifold module is detachably carried thereby.

5. A manifold means as set forth in claim 4 wherein said terminal block for each manifold module has snap-fit means, each said manifold module having snap-fit means cooperating with said snap-fit means of its respective terminal block to detachably carry the same.

6. A manifold means as set forth in claim 1 wherein said manifold means includes a frame plate, said manifold modules being secured to said frame plate to be thereby secured together to provide said manifold unit.

7. A manifold means as set forth in claim 6 wherein said frame plate has means for carrying said manifold modules in side-by-side relation.

8. A manifold means as set forth in claim 6 wherein said frame plate has a plurality of fastening means, each said manifold module having fastening means cooperating with said fastening means of said frame plate to be secured thereto.

9. A manifold means as set forth in claim 8 wherein said fastening means of said frame plate are integral therewith and said fastening means of each said manifold module are integral therewith.

10. A manifold means as set forth in claim 9 wherein said fastening means of said frame means and said manifold modules are quick-connect and quick-disconnect type fastening means.

11. In a method of making a manifold means adapted to detachably carry on one side thereof a plurality of pneumatically and electrically operated control units each of which is adapted to be fluidly and electrically interconnected to pneumatic means and electrical means of said manifold means that respectively have external interconnection means on said one side of said manifold means so that external pneumatic and electrical lines can be interconnected to the same side of said manifold means that said units are adapted to be interconnected thereto, the improvement comprising the steps of forming said manifold means from a plurality of like manifold modules secured together to provide a manifold unit and each having part of said pneumatic means and said electrical means and having one side thereof forming part of said one side of said manifold means, and forming said one side of each manifold module to be adapted to carry one of said control units and have said external interconnection means respectively for said pneumatic means and electrical means thereof.

12. A method of making a manifold means as set forth in claim 11 and including the step of forming said external interconnection means for said electrical means of each module to be detachably carried by the respective manifold module.

13. A method of making a manifold means as set forth in claim 11 and including the step of forming said external interconnection means for said electrical means of each manifold module from a terminal block having a plurality of separate electrical terminals thereon.

14. A method of making a manifold means as set forth in claim 13 and including the step of forming said terminal block for each manifold module to be detachably carried thereby.

15. A method of making a manifold means as set forth in claim 14 and including the steps of forming said terminal block for each manifold module with snap-fit means, and forming each said manifold module with snap-fit means to cooperate with said snap-fit means of its respective terminal block so as to detachably carry the same.

16. A method of making a manifold means as set forth in claim 11 and including the steps of forming said manifold means to include a frame plate, and securing said manifold modules to said frame plate to be thereby secured together to provide said manifold unit.

17. A method of making a manifold means as set forth in claim 16 and including the step of forming said frame plate to have means for carrying said manifold modules in side-by-side relation.

18. A method of making a manifold means as set forth in claim 16 and including the steps of forming said frame plate to have a plurality of fastening means, and forming each said manifold module to have fastening means cooperating with said fastening means of said frame plate to be secured thereto.

19. A method of making a manifold means as set forth in claim 18 and including the step of forming said fastening means of said frame plate to be integral therewith, and forming said fastening means of each said manifold module to be integral therewith.

20. A method of making a manifold means as set forth in claim 19 and including the step of forming said fastening means of said frame means and said manifold module to be quick-connect and quick-disconnect type fastening means.

21. In a combination of a manifold means detachably carrying on one side thereof a plurality of pneumatically and electrically operated control units each of which is fluidly and electrically interconnected to pneumatic means and electrical means of said manifold means that respectively have external interconnection means on said one side of said manifold means so that external pneumatic and electrical lines can be interconnected to the same of said manifold means that said units are adapted to be interconnected thereto, the improvement wherein said manifold means comprises a plurality of like manifold modules secured together to provide a manifold unit and each having part of said pneumatic means and said electrical means and having one side thereof forming part of said one side of said manifold means, said one side of each manifold module carrying one of said control units and having said external interconnection means respectively for said pneumatic means and electrical means thereof.

22. A combination as set forth in claim 21 wherein said external interconnection means for said electrical means of each module is detachably carried by the respective manifold module.

23. A combination as set forth in claim 21 wherein means of each manifold module comprises a terminal block having a plurality of separate electrical terminals thereon.

24. A combination as set forth in claim 23 wherein said terminal block for each manifold module is detachably carried thereby.

25. A combination as set forth in claim 24 wherein said terminal block for each manifold module has snap-fit means, each said manifold module having snap-fit means cooperating with said snap-fit means of its respective terminal block to detachably carry the same.

26. A combination as set forth in claim 21 wherein said manifold means includes a frame plate, said manifold means being secured to said frame plate to be thereby secured together to provide said manifold unit.

27. A combination as set forth in claim 26 wherein said frame plate has means for carrying said manifold moduls in side-by-side relation.

28. A combination as set forth in claim 26 wherein said frame plate has a plurality of fastening means, each said manifold module having fastening means cooperation with said fastening means of said frame plate to be secured thereto.

29. A combination as set forth in claim 28 wherein said fastening means of said frame plate are integral therewith and said fastening means of each said manifold module are integral therewith.

30. A combination as set forth in claim 29 wherein said fastening means of said frame means and said manifold modules are quick-connect and quick-disconnect type fastening means.

31. A manifold module for making a manifold means adapted to detachably carry on one side thereof a plurality of pneumatically and electrically operated control units each of which is adapted to be fluidly and electrically interconnected to pneumatic means and electrical means of said manifold means that respectively have external interconnection means on said one side of said manifold means so that external pneumatic and electrical lines can be interconnected to the same side of said manifold means that said units are adapted to be interconnected thereto, said manifold module having part of said pneumatic means and said electrical means and having one side thereof adapted to form part of said one side of said manifold means, said one side of said manifold module being adapted to carry one of said control units and having said external interconnection means respectively for said pneumatic means and electrical means thereof.

32. A manifold module as set forth in claim 31 wherein said external interconnection means for said electrical means of said module is detachably carried by said manifold module.

33. A manifold module as set forth in claim 31 wherein said external interconnection means for said electrical means of said manifold comprises a terminal block having a plurality of separate electrical terminals thereon.

34. A manifold module as set forth in claim 33 wherein said terminal block for said manifold module is detachably carried thereby.

35. A manifold module as set forth in claim 34 wherein said terminal block for said manifold module has snap-fit means, said manifold module having snap-fit means cooperating with said snap-fit means of its said terminal block to detachably carry the same.

36. A method of making a manifold module for forming a manifold means adapted to detachably carry on one side thereof a plurality of pneumatically and electrically operated control units each of which is adapted to be fluidly and interconnected to pneumatic means and electrical means of said manifold means that respectively have external interconnection means on said one side of said manifold means so that external pneumatic and electrical lines can be interconnected to the same side of said manifold means that said units are adapted to be interconnected thereto, said method comprises the steps of forming said manifold module to having part of said pneumatic means and said electrical means and have one side thereof adapted to form part of said one side of said manifold means, and forming said one side of said manifold module to be adapted to carry one of said control units and have said external interconnection means respectively for said pneumatic means and electrical means thereof.

37. A method of making a manifold module as set forth in claim 36 and including the step of forming said external interconnection means for said electrical means of said module so as to be detachably carried by said manifold module.

38. A method of making a manifold module as set forth in claim 36 and including the step of forming said external interconnection means for said electrical means of said manifold module from a terminal block having a plurality of separate electrical terminals thereon.

39. A method of making a manifold module as set forth in claim 38 and including the step of forming said terminal block for said manifold module so as to be detachably carried thereby.

40. A method of making a manifold module as set forth in claim 39 and including the steps of forming said terminal block for said manifold module with snap-fit means and forming said manifold module with snap-fit means that cooperate with said snap-fit means of its said terminal block to detachably carry the same.

41. A frame plate for making a manifold means by carrying a plurality of manifold modules thereon, said frame plate having a plurality of openings therein to snap fittingly receive fastening means of said manifold modules therein so that said manifold modules will be detachably carried thereby.

42. A frame plate as set forth in claim 41 wherein said opening means are arranged so that said manifold modules can be carried by said frame plate in side-by-side relation.

43. A frame plate as set forth in claim 41 wherein said frame plate has lever means respectively adapted to unlock said manifold modules from said snap-fit relation with said frame plate.

44. A method of making a frame plate for forming manifold means by carrying a plurality of manifold modules thereon, said method comprising the step of forming said frame plate with a plurality of openings therein to snap fittingly receive fastening means of said manifold modules therein so that said manifold modules will be detachably carried thereby.

45. A method of making a frame plate as set forth in claim 44 and including the step of forming said opening means in arrangement so that said manifold modules can be carried by said frame plate in side-by-side relation.

46. A method of making a frame plate as set forth in claim 44 and including the step of forming said frame plate with lever means respectively adapted to unlock said manifold modules from said snap-fit relation with said frame plate.

* * * * *